United States Patent [19]

Yoshimi

[11] 4,403,120

[45] Sep. 6, 1983

[54] EARPHONE

[75] Inventor: Toshikazu Yoshimi, Tokorozawa, Japan

[73] Assignee: Pioneer Electronic Corporation, Tokyo, Japan

[21] Appl. No.: 278,036

[22] Filed: Jun. 29, 1981

[30] Foreign Application Priority Data

| | | | |
|---|---|---|---|
| Jun. 30, 1980 | [JP] | Japan | 55-87936 |
| Jul. 4, 1980 | [JP] | Japan | 55-90521 |
| Jul. 4, 1980 | [JP] | Japan | 55-90522 |
| Jun. 30, 1980 | [JP] | Japan | 55-90547[U] |

[51] Int. Cl.[3] ..... H04R 1/10

[52] U.S. Cl. ..... 179/182 R; 179/182 A; 179/107 E; 181/129; 181/130

[58] Field of Search ..... 179/182 R, 182 A, 107 R, 179/107 E, 107 H, 107 S; 181/130, 131, 132, 133, 129

[56] References Cited

U.S. PATENT DOCUMENTS

| | | | |
|---|---|---|---|
| 1,560,718 | 11/1925 | Nowosielski . | |
| 1,753,817 | 4/1930 | Aber | 179/182 |
| 2,391,924 | 1/1946 | Rutter et al. | 179/167 |
| 2,474,135 | 6/1949 | White | 179/182 R |
| 3,293,379 | 12/1966 | Görike | 179/182 |
| 3,440,365 | 4/1969 | Bryant et al. | 179/156 |
| 3,586,794 | 6/1972 | Michaelis | 179/182 R |

*Primary Examiner*—G. Z. Rubinson
*Assistant Examiner*—Robert Lev
*Attorney, Agent, or Firm*—Sughrue, Mion, Zinn, Macpeak and Seas

[57] ABSTRACT

A high performance and extremely compact earphone is disclosed. The earphone includes a speaker unit and a case in which the speaker unit is mounted. The earphone is attachable to a cavity of a conha defined by the tragus and a confronting projection of the pinna of the ear. The earphone has a specific physical configuration such that the earphone is firmly fitted to the ear cavity by the resiliency and friction of the ear.

10 Claims, 20 Drawing Figures

EARPHONE

BACKGROUND OF THE INVENTION

The present invention relates to earphones, a large variety of which have been proposed in the art. The prior art earphones are generally classified into types shown in FIGS. 1(*a*) to (*d*) according to the manner in which they are attached to the ear. FIG. 1(*a*) shows a pair of earphones in a headphone arrangement. The headphone is made up of a pair of speaker units 1, a head band 2 coupling the speaker units 1, and a cord 3 through which electrical signals are supplied to the speaker units 1. The head band 2 has a resiliency so as to fit the speaker units 1 to the user's ears. Due to the head band 2, a rather great pressure may be applied to the user's temples or the external ears or pinnae. Also, with such a construction, since the speaker units 1 are fitted on the external ears or pinnae, each speaker unit 1 is far from the external meatus of the ear canal and the space defined therebetween is rather large. Therefore, only part of the acoustic energy emanating from each speaker unit 1 is supplied into the ear canal while remainder is leaked, thereby decreasing the efficiency of the headphone.

Due to the presence of the acoustic chamber defined by the speaker unit 1 and the external ear, sound reflected from the surface of the external ear and the unit results in a degradation of acoustic characteristics. For this reason, it is difficult to provide high performance headphones of this type.

FIG. 1(*b*) shows a so-called ear hook type earphone. The ear hook type is made up of a speaker unit 1, an ear suspension loop 12 formed integrally with the unit 1 and a cord 3 through which electrical signals are supplied. The earphone thus constructed is hooked around the external ear or pinna to hold the unit 1. However, the fit thus provided is not stable and it is difficult to attach and detach the earphone from the external ear. Furthermore, in this type, the unit 1 is in contact with the external ear or positioned in the vicinity of the external ear. For the same reason as in the above described headphone, this earphone is inferior in acoustic characteristics.

FIG. 1(*c*) shows a "stethophone" type earphone set. It is composed of a pair of speaker units 1, a band 2 in the form of a stethoscope and a cord 3 through which electrical signals are supplied. The units 1 are held close to the external ears or pinnae with a pair of projected acoustic tubes 4 held in contact with parts of the external ears or pinnae by the resilient force of the band 3.

FIG. 1(*d*) shows an earphone which is composed of a speaker unit 1, an ear plug 5 extending from a front surface of the unit 1 and a cord 3 through which electrical signals are supplied. The ear plug 5 serving as an acoustic tube is inserted into the external auditory meatus.

The fit obtained with the devices shown in FIGS. 1(*c*) and (*d*) is not stable and these earphones are all easily pulled away from the user's ears. Moreover, in the known devices as shown in FIGS. 1(*c*) and (*d*), generated sounds are propagated via acoustic tubes. Such a construction cannot provide desirable acoustic characteristics.

FIG. 1(*e*) shows a prior art headphone wherein a speaker unit is composed of a magnetic circuit 60 having a magnetic gap 60*a*, a vibrating diaphragm 61 having a voice coil 61*a* and a frame 63 to which the magnetic circuit 60 is directly secured and to which the diaphragm 61 is secured through a ring 62. The speaker unit is encased and secured in a protective case 64 made up of a body 64*a* and a cover 64*b*. An ear pad 65 is attached to a sound hole 64*b*' of the cover 64*b*. Sound absorbing material 66 is attached to the bottom of the body 64*a*. Reference numeral 63*a* denotes sound holes formed in the frame 63.

Since in the prior art headphone shown in FIG. 1(*e*), the outer periphery of the frame in which the diaphragm is provided is secured to the inner periphery of the body of the case to thereby fix the speaker unit at a desired predetermined position and then the cover 64*b* is attached to the outer periphery of the body, the outer diameter of the case is considerably large in comparison with the diameter of the diaphragm. The space use efficiency thereof is inferior. With such a construction, it is very difficult to miniaturize the ear speaker.

As described above, the various types of known ear speakers cannot simultaneously satisfy both compactness and high performance requirements.

In view of the above noted defects inherent to the prior art techniques it is an object of the present invention to provide a novel ear speaker with compactness and high performance.

SUMMARY OF THE INVENTION

The present invention provides an earphone including a speaker unit and a case in which the speaker unit is mounted. The earphone of the invention is attachable to a cavity of the conha defined between the tragus of the ear and a confronting projection of the pinna and having a configuration and has a size such that the earphone will be held in this cavity by the resiliency and friction of the tragus and the confronting projection of said pinna.

The present invention, also provides an earphone having a speaker unit having a vibrating diaphragm and a case in which the speaker unit is mounted. The speaker unit is provided with a sound hole through which sound propagates, and the earphone is attachable to a cavity of a conha defined between the tragus and a confronting projection of the pinna and just in front of the auditory meatus having a configuration and a size such that the earphone will be held in the cavity by the elastic and frictional force of the tragus and the confronting projection of the pinna. A relationship $S_1 > S_2 > S_3$ is established, where $S_1$ is the diameter or area of the vibrating diaphragm, $S_2$ is the diameter or opening area of the sound hole and $S_3$ is the diameter or opening area of the auditory meatus.

The invention further provides an earphone including a substantially cup-shaped outer case, sound generating means incuding a magnetic circuit and a vibraing circuit, an annular frame carrying the sound generating means, and first coupling means for coupling the outer case and the annular frame so as to form a first flush outer surface between the outer case and the annular frame. The earphone further includes a front cover so as to form a second flush outer surface between the outer case and the annular frame.

According to another aspect of the present invention, an extension is formed from a rear side surface of the speaker case for positioning and aligning the earphone in conformance with the auditory canal, and the external cavity defined by the tragus and a confronting projection of the pinna.

BRIEF DESCRIPTION OF THE DRAWINGS

The present invention will be more clearly understood upon reference to the accompanying drawings in which.

DESCRIPTION OF THE PREFERRED EMBODIMENTS

Figure 1A:
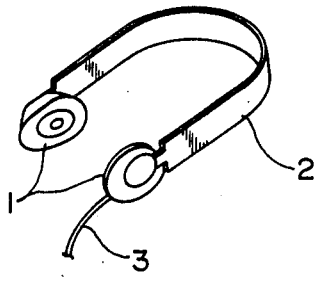
FIG. 1(a) PRIOR ART
FIGS. 1(*a*) to (*e*) are illustrations showing various types of prior art earphones.
Figure 1B:
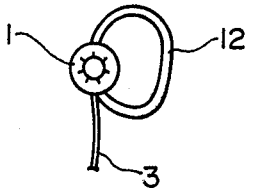
FIG. 1(b) PRIOR ART
Figure 1C:
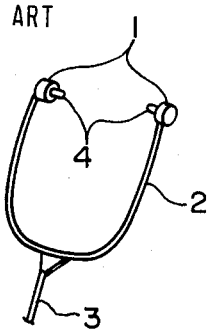
FIG. 1(c) PRIOR ART
Figure 1D:
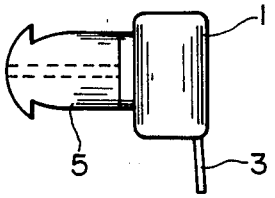
FIG. 1(d) PRIOR ART
Figure 1E:
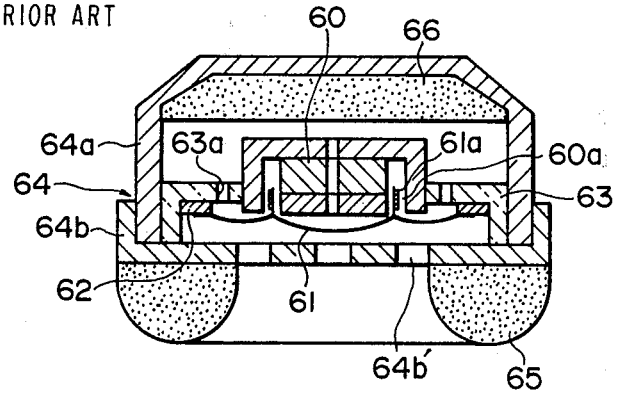
FIG. 1(e) PRIOR ART
Figure 2:
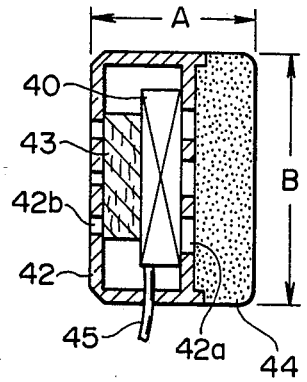
FIG. 2 is a cross-sectional view showing a preferred embodiment of an earphone according to the invention.

A preferred embodiment of an earphone of the present invention will now be described with reference to the accompanying drawings. In FIG. 2, reference 40 designates a dynamic electromagnetic speaker unit adapted to vibrate a voice coil disposed in a magnetic gap in a magnetic circuit and a vibrating diaphragm coupled to the voice coil upon application of a signal current to the coice coil. Reference numeral 42 designates a case made of lght metal such as aluminum or hard plastics. The case 42 is provided with front sound holes 42*a* and rear sound holes 42*b*. In the case 42, the above described dynamic speaker unit 40 is fixed on the side of the front sound hole 42*a*, and sound absorbing material 43 is disposed between the speaker unit 40 and the rear sound holes 42*b*. A front surface on the front sound hole side of the case 42 is covered with a porous elastic member or a cover member 44 which is acoustically permeable. Thus, the front surface of the case 42 is covered by the cover member 44. The overall earphone has for example, a height A of 10 mm and a diameter B of 15 mm. The speaker unit 40 is substantially in the form of a cylinder. The speaker is provided with a connecting cords 45 through which electrical signals are supplied from an outside source, the cord passing through a side wall of the case 42.

Figure 3:
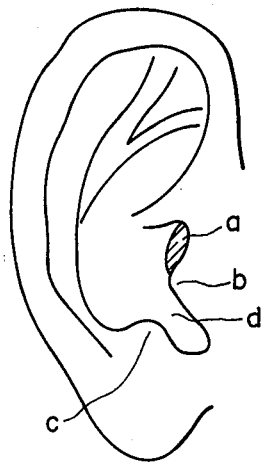
FIG. 3 is a schematic diagram of a human ear as viewed from the oblique front side.
Figure 4:
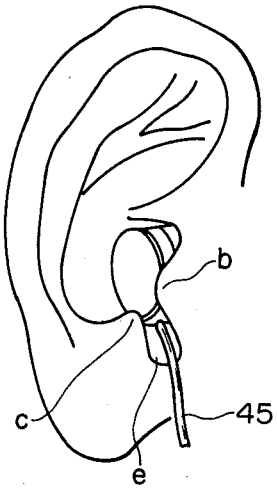
FIG. 4 is a view showing a fitting state of the earphone of the present invention.

The thus constructed earphone, as shown in FIG. 4, is adapted to be positioned in an outer external ear cavity d defined between the tragus b of the ear and an associated confronting projection c positioned in front of the external auditory meatus a. The respective ear parts are clearly shown in FIG. 3. The earphone has a configuration and a size such that it is held by the frictional force provided between the walls of the external ear cavity d and the tragus b and an associated projection c.

Figure 5:
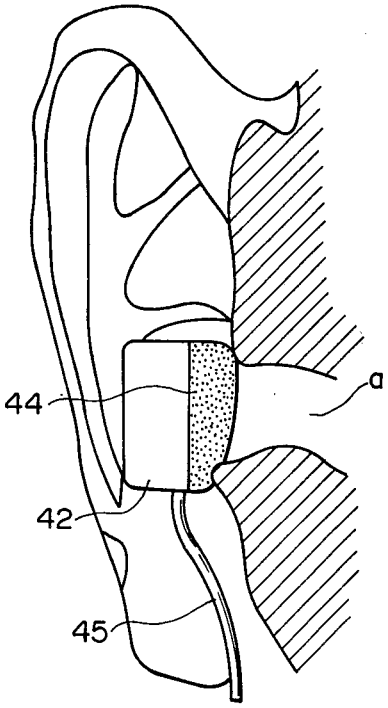
FIG. 5 is a cross-sectional view of the earphone shown in FIG. 4 placed in an operating position.

As best shown in FIG. 4, the cord 45 of the speaker extends through the recess in the tragus e to the outside. As shown in FIG. 5, the front cover 44 of the case 42 is in contact with an outlet portion of the meatus a and is deformed in compliance with the configuration of the external ear cavity d. The front cover 44 serves as a cushion.

Figure 6:
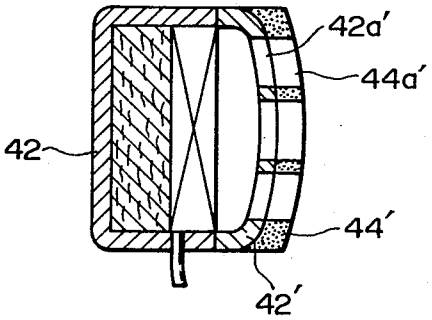
FIG. 6 is a view showing a modification of an earphone of the present invention.

FIG. 6 shows another embodiment of the invention in which a front portion 42' of the case 42 and its front cover 44' are made arcuate in compliance with the configuration of the external ear cavity d. Therefore, the fitting property of the earphone is further improved and the fit becomes more stable. In this embodiment, holes 44*a'* which communicate with sound holes 42*a'* of the front portion 42' are formed in the cover 44'. Also in this embodiment, the front portion of the case 42 is covered only by the cover 44' made of elastic material. However, it is possible to cover the entire outer periphery of the case with elastic material to impart to the surfaces thereof elasticity or to cover the entire outer periphery of the case with rubber, cloth or leather to enhance the frictional characteristics and the fitting characteristics.

Figure 7:
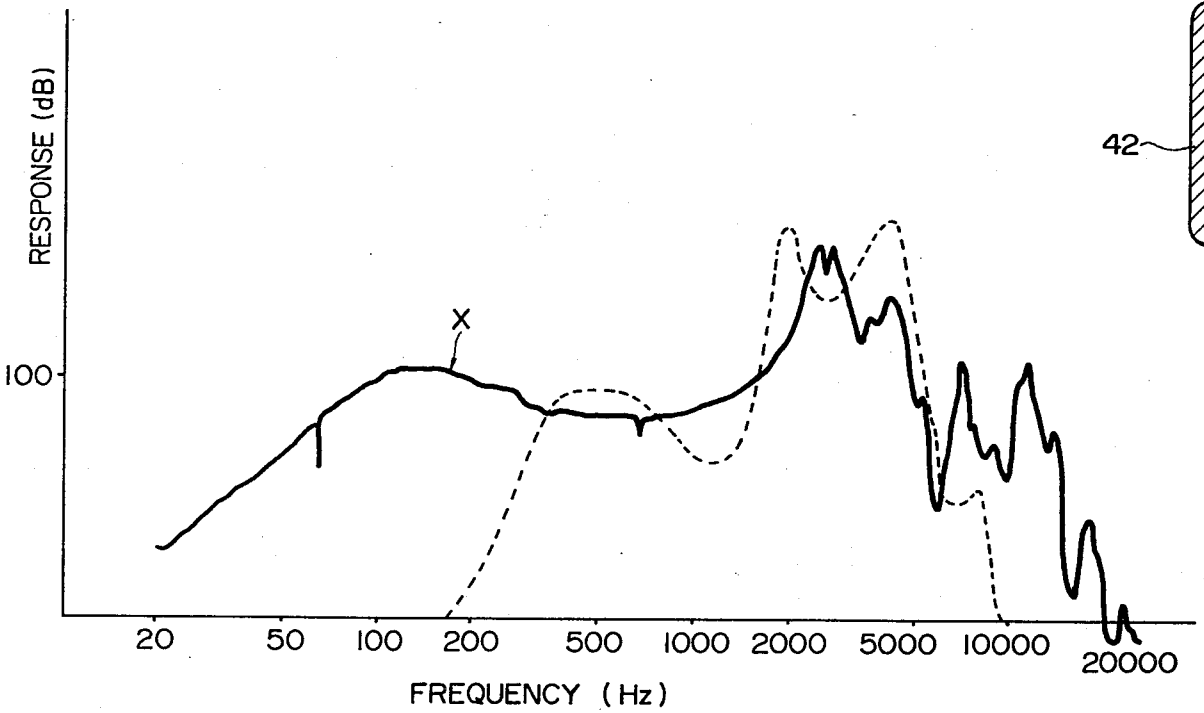
FIG. 7 is a graph showing the frequency response characteristics of an earphone of the invention and a prior art earphone.

FIG. 7 is a graph showing a difference between the earphone of the present invention and a prior art earphone. The earphone of the present invention and the prior art are designated by solid and broken lines, respectively. In the earphone according to the invention, sensitivity in the vicinity of 500 Hz at an input power 1 mw was measured at 96.5 dB in terms of sound pressure level. As shown, it is apparent from the frequency characteristics of the earphone of the invention that the frequency response curve has a flat property even in the low frequency range X.

As mentioned above, the earphone according to the present invention is provided with the speaker unit and the case in which is mounted the speaker unit, and can be attached to the recess or cavity defined by the tragus and the associated confronting projection of the external ear. The earphone of the invention is held firmly by the frictional force and the elastic force provided by the tragus and the associated projection. The earphone has a form satisfying the above-noted requirements. For this reason, the earphone of the invention is adequately compact and light and easy to carry. This earphone is held in the ear with natually-provided pressure. No additional force is needed for fitting the earphone to the ear. No part of the earphone is inserted into the earhole. For this reason, no unduly high force is needed for insertion and no adversely sensation is felt by the user. On the other hand, since the speaker unit is positioned close to the external auditory earhole, the leakage of sound to the outside is quite small and the propagation area is decreased to thereby improve the efficiency of the earphone. Furthermore, since no acoustic tube is needed, it is possible to obtain wide band frequency response characteristics. In particular, if a dynamic speaker unit is used, good sound quality will be obtained.

Another embodiment of the present invention will now be described with reference to the accompanying drawings.

Figure 8:
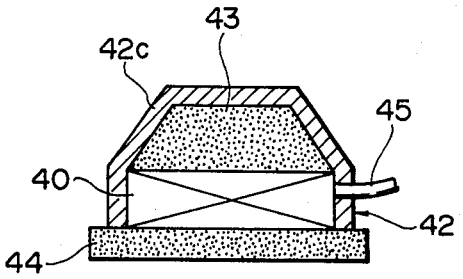
FIG. 8 is a cross-sectional view of another embodiment of an earphone of the present invention.

In FIG. 8, reference numeral 40 denotes a dynamic speaker unit in which a voice coil disposed in a magnetic gap of the magnetic circuit and a vibrating diaphragm are vibrated by alternating current signals fed to the voice cail. Reference 42 denotes a case made of a light metal such as aluminum or hard plastics. The case is generally a cup-shaped. The speaker unit 40 is fixed to the inlet portion of the case 42 and a sound absorbing material 43 is enclosed between the bottom portion of the case 42 and the speaker unit 40. A front portion of the case 42 is covered by a porous elastic material such as urethane foam or a cover member 44 having acoustically permeable characteristics. A cord 45 is connected to the speaker unit 40 through a side wall of the case 42.

The above described cup-shaped case 42 has a constant diameter at the part thereof corresponding to the speaker unit 40 mounted therein. That part of the case 42 is in the form of a cylinder. A portion 42*c* of the case 42 is tapered toward the rear side of the speaker unit 40.

Figure 9:
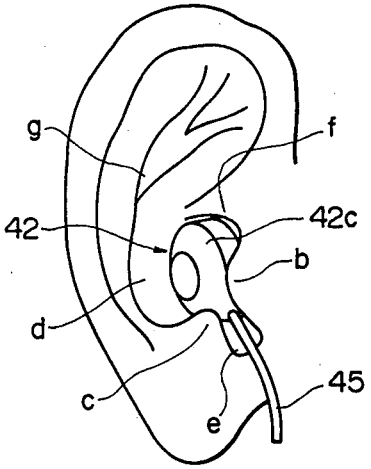
FIG. 9 is a view showing a fitting state of the earphone shown in FIG. 8.
Figure 10:
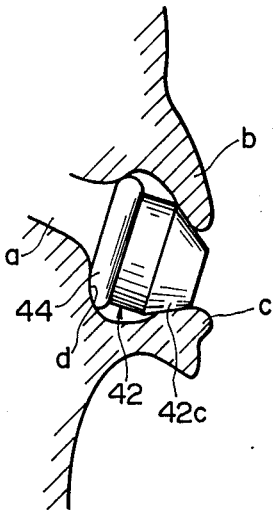
FIG. 10 is a cross-sectional view of an outer ear to which the earphone shown in FIG. 9 is attached.

The thus modified earphone is held at the pinna shown in FIGS. 9 and 10. The human ear shown in FIGS. 9 and 10 includes a cavity or a conha d position just in front of the auditory meatus a, a crus(helias) f and a confronting crus g around the cavity.

In use of such an earphone, the the same manner as in the previous case, the tapered surface 42*c* is in intimate contact with the tragus b and the confronting projection c, and the earphone is fully positioned in the cavity and is firmly held by the elasticity and friction of the tragus b and the confronting projection c. Also, in this case, the cord 15 extends outwardly through the recess e in the tragus.

Figure 11:
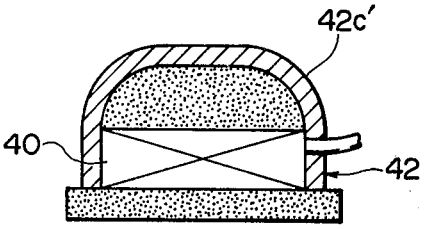
FIG. 11 shows a modification of the earphone shown in FIG. 9.

FIG. 11 shows a modification of the present invention. Instead of the tapered surface 42*c*, a rounded surface 42*c*′ is formed in the corresponding portion of the case 42. Due to the provision of this rounded surface, the fit of the earphone is further improved.

Figure 12:
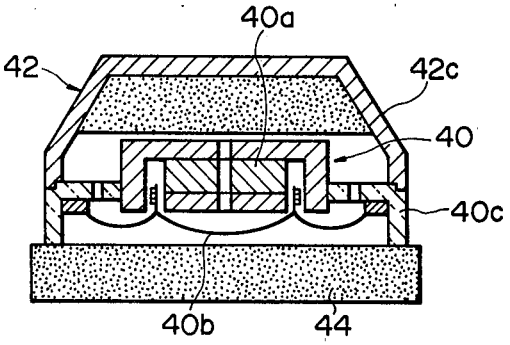
FIG. 12 is a cross-sectional view of a modified structure of the earphone of the invention.

In FIG. 12, showing a further modification of the earphone according to the present invention, a speaker unit 40 is mounted in a case 42 so that an outer surface of a frame 40*c* which forms a speaker unit 40 together with a magnetic circuit 40*a* and a diaphragm 40*b* projects outwardly to thereby form a flush surface with the large diameter portion of the case 42. A cover 44 is attached to the opening portion of the frame 40*c* of the speaker unit 40. A sandwiched construction is thus formed. In the same matter as described above, a tapered portion 42*c* is formed on the rear side of the speaker unit 40 to thereby enhance the space efficiency.

In these embodiments, since the tapered portion or rounded portion is formed in the case and the speaker is readily attachable in the cavity of conha, particularly to the tragus and the confronting projection, the feel of the earphone is further enhanced and the space of the speaker unit is considerably broadened. The space efficiency is increased and also the acoustic characteristics are improved.

Figure 13:
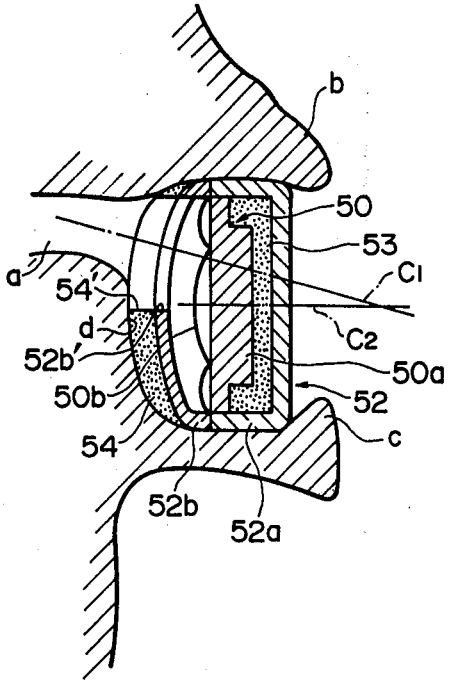
FIG. 13 is a cross-sectional view of an earphone of the present invention in an operation position.

Still another embodiment according to the present invention will now be described with reference to FIG. 13 in which reference numeral 50 designates a dynamic speaker unit in which a voice coil disposed in a magnetic gap of a magnetic circuit 50*a* and a vibrating diaphragm 50*b* coupled to the voice coil are vibrated by application of an excitation current to the voice coil. The vibrating diaphragm 50*b* has an area $S_1$. Reference numeral 52 denotes a case made of a light material such as aluminum or hard plastics which has a cup-shaped body 52*a* and a cover 52*b* covering the opening of the body 52*a*. In the case 52, the above-described speaker unit 50 is suitably fixed on the opening side of the body 52*a*. A sound absorbing material 53 is disposed between the bottom of the body 52*a* and the speaker unit 50. A rounded surface is provided at the front surface of the cover 52*b* of the case 52. An ear pad 54 having a shape which comforms to the rounded surface is attached to the front surface. The ear pad 54 is formed of porous material such as urethane foam which has acoustically permeable characteristics. Sound holes 52*b*′ and 54′ having an opening area $S_2$ and a corresponding diameter are formed in the cover 52*b* and the ear pad 54, respectively, away from the center of speaker unit 50. The diameter or the opening area $S_2$ of the sound holes 52*b*′ and 54′ is smaller than the area $S_1$ of the diaphragm 50*b* of the speaker unit 50 to thereby enhance the directionability and sound coupling efficiency of the diaphragm 50*b*. Electric signals are supplied through a cord 55 to the side wall of the case 12.

It should be noted that the entrance of the meatus a is at the center of the cavity of the conha d but at the base portion of the tragus b. Therefore, as mentioned above, the position of the sound hole 52*b*′ of the cover 52*b* is placed away from the center of the diaphragm 50*b* and the respective center lines $C_1$ and $C_2$ of the sound hole 52*b*′ and the diaphragm 50*b* form an angle such that the sound hole 52*b*′ is away from the center. Accordingly, the sound hole 52*b*′ of the cover 52*b* is in alignment with the entrance of the meatus a. As a result, the sound generated by the diaphragm is radiated directly to the vicinity of the entrance of the meatus, thereby reducing the leakage of sound to the outside. The sound of the vibrating diaphragm is thus very effectively introduced into the meatus a.

According to the physical difference of the user's ears, for example, the size of conha d and the size and position of the meatus a, the relative position of the sound hole 52*b*′ of the cover 52*b* and the positions of the entrance of the meatus a are liable to be offset from each other. However, due to the fact that the diameter or the area $S_2$ of the sound hole 52*b*′ of the cover 12*b* is made larger than a diameter or an area $S_3$ of the entrance of the meatus a, acoustic problems caused by such physical variations are eliminated to thereby provide superior acoustic characteristics.

As described above, the relationship $S_1 > S_2 > S_3$ is established. Accordingly, the sound generated by the diaphragm is supplied with directionality from the sound hole to the meatus while at the same time, although there can be physical variations, the sound hole of the earphone will be in alignment with the inlet of the meatus to thereby provide stable acoustic properties.

As mentioned above, an earphone which must be attached to the conha d is very compact and positioned at a very restricted position with respect of the pinna. However, the acoustic characteristics, specifically, the acoustic propagation characteristic to the meatus a, are greatly affected by the fitting condition. Thereofre, it is not sufficient to simply attach such an earphone to the inner space of the pinna.

Figure 14:
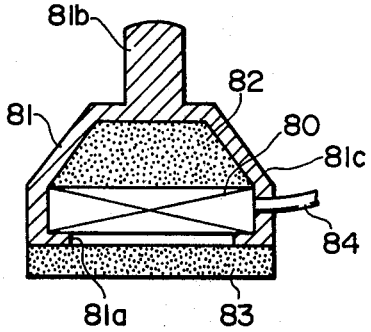
FIG. 14 is a cross-sectional view of an earphone having an extension.
Figure 15:
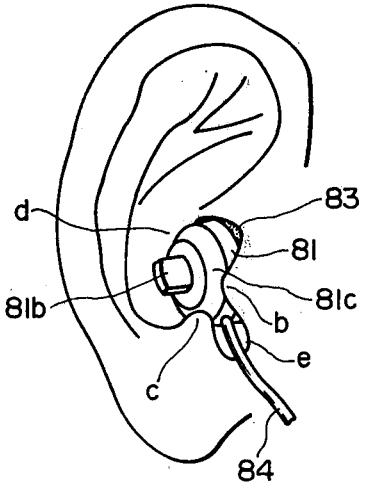
FIG. 15 is a view of the earphone of FIG. 14 attached to the human ear.

In FIG. 14, reference numeral 80 designates a speaker unit and reference numeral 81 deontes a case. An extension or knob 81*b* is formed on the rear side of the case 81. The extension is used to accurately align the speaker unit when it is not suitably positioned in the conha d by grasping the extension 81*b* with the fingers and the extension is also used for attachment of the earphone to the conha d. The extension 81*b* may be formed integrally with the case 81 and made of light metal such as aluminum or plastics. Otherwise, the extension 81*b* may be formed of a separate member. The extension projects somewhat beyond the tragus b and confronting projection and is configured in a flat form as shown for ready grasping with the user's fingers. The flat portion serves to allow the user to quickly and accurately position the earphone. FIG. 15 shows the earphone attached to the ear.

Figure 16:
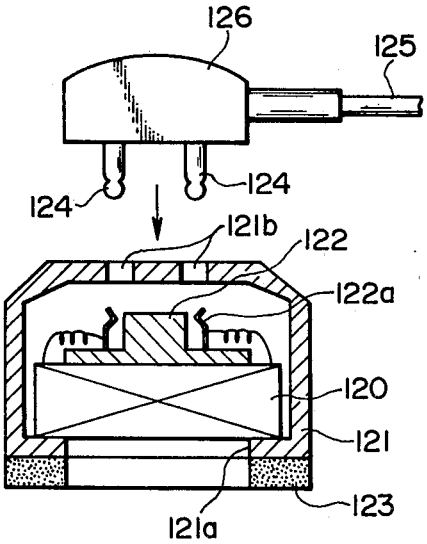
FIG. 16 shows another modification of an earphone of the invention.

FIG. 16 shows another embodiment of the present invention. Reference numeral 120 denotes a speaker unit and reference numeral 121 denotes a case in which the speaker unit 120 is mounted. A terminal plate 122 having receiving terminals 122*a* electrically coupled to the speaker unit is fixed in the case 121. The front surface of the case 121 is provided with a sound hole 121*a* and an ear pad 123 having a hole in alignment with the sound hole 121*a*. The rear side surface of the case 121 is provided with plug holes 121*b* through which prongs 124 electrically connected to the receiving terminals 122*a* are inserted. The cord 125 is connected to the prongs 124 for applying electric signals thereto. The prongs 124 are attached to a plug case 126 made of plastics. Thus, the plug case 126 can be used as an extension for adjustment and attachment as described above.

Figure 17A:
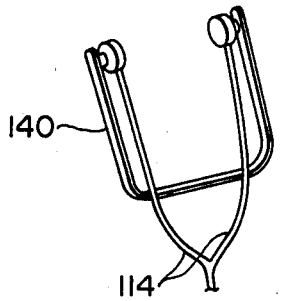
FIGS. 17(*a*) to (*c*) show a coupling portion of the extension of the earphone of FIG. 14.
Figure 17B:
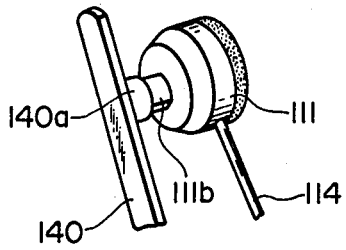
Figure 17C:
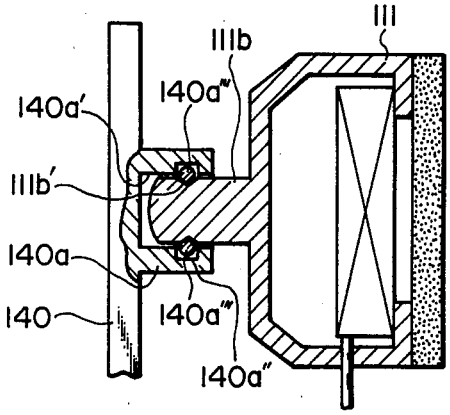

FIG. 17(*a*) shows another modification according to the present invention suitable for use with either sterophonic or monaural audio equipment. A U-shaped band 140 is provided around which a cord 114 can conveniently be mounted. Also it is easy to handle the speaker device due to the provision of the U-shaped band 140.

A pair of speaker units are coupled to each other through the U-shaped band 140. As shown in FIG. 17(*b*), each of the speaker units 140 is fixedly but separately mounted on the U-shaped band with an extension 111*b* of the speaker unit engaged with a receiving portion 140*a* of the band 140. FIG. 17(*c*) shows clerly the detachable mount portion thereof. A C-shaped spring 140*a*''' having a spring resiliency in the radial and inward direction is received in an annular groove 140*a*'' formed in an inner wall of a recess 140*a*' of the mount portion 140*a* of the band 140. Then, an extension 111*b* of the case 111 is pressingly inserted into the recess 140*a*' against the resilient force of the C-shaped spring 140*a*''' whereby the C-shaped spring 140*a*''' is engaged with an annular V-shaped groove 111*b*' formed in the extension 111*b*. In disassembling, the extension 111*b* is pulled apart from the recess 140*a*' so that the band 140 can be removed from the earphone set. The extensions in this condition serves as knobs for alignment.

Figure 18A:
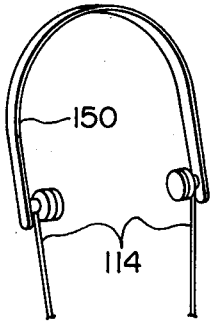
FIGS. 18(*a*) and (*b*) show a similar coupling portion of the extension of the earphone.
Figure 18B:
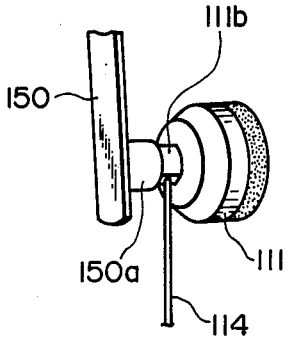

FIGS. 18(*a*) and (*b*) show another assembly having a head band 150 and a mount portion 150*a*. In this case, a like mount structure can be used.

Figure 19:
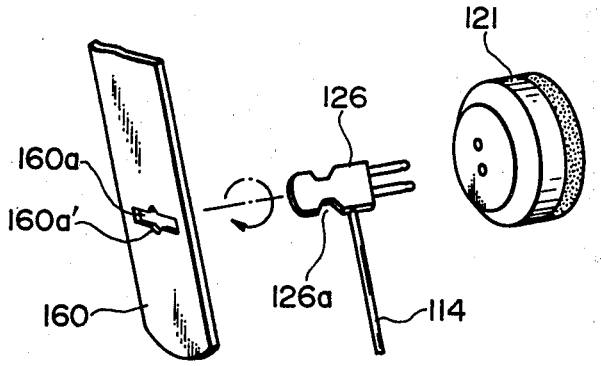
FIG. 19 is a developed perspective view of an example of an earphone of the invention.

FIG. 19 shows a modification of the mount structure. A mount hole 160*a* is formed at an end portion of a head band 160. A plug case 126 which is separable from a speaker unit 121 can be inserted into the hole 160*a* by rotation of the plug case by an angle of 90°. The plug case 126 has a waist portion 126*a* which conforms to cutouts 160*a*'.

Figure 20:
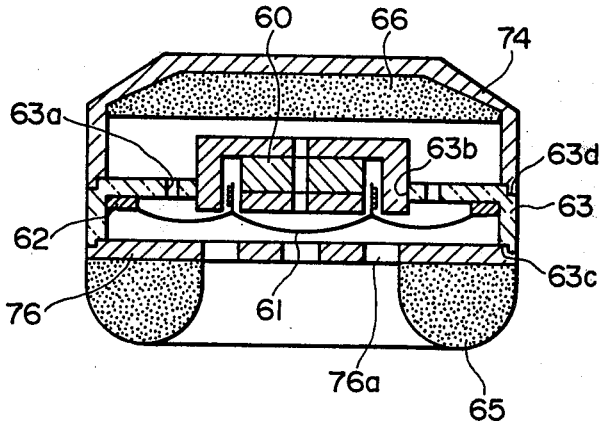
FIG. 20 is a cross-sectional view of a headphone to which the invention is applied.

FIG. 20 shows another embodiment of the present invention applied to a headphone construction. The same reference numerals and characters used in FIG. 1(*e*) are used in FIG. 20 to show like components. The speaker unit shown in FIG. 20 is a general moving coil type dynamic unit. A central hole 63*b* is formed in the cup-shaped frame 63. A magnetic circuit 60 is inserted into the central hole 63*b*. A vibrating diaphragm 61 is secured to a ring 62 fixed to the bottom portion of the frame 63. Concave portions 63*c* and 63*d* are formed in the frame 63 as shown.

The rear side of the speaker unit is covered by a cup-shaped rear cover 74 having the same diameter as that of the outer peripheral diameter of the frame 63. The recess portion 63*d* serves as the positioning member when the cover 74 is attached to the speaker unit with adhesive or the like. The front side of the speaker unit is covered by a planar front cover 76 having the same diameter as the outer diameter of the frame 63. The recess portion 63*c* serves as a positioning member. Sound holes 76*a* are formed in the front cover 74 and an ear pad 65 is attached to the front cover 76. In the same manner as described above, sound absorbing material 56 is encased in the bottom of the rear cover 74.

As mentioned above, the outer periphery of the frame in which the speaker unit is mounted with the magnetic circuit 60 and the diaphragm 61 projects to the outside because the outer diameter of the frame is substantially the same as that of the rear cover and the front cover. With such a construction, the diameter of the speaker unit and the vibrating unit can be relatively widened if desired.

What is claimed is:

1. An earphone comprising a case of circular cross-section having a diameter permitting said case to be frictionally held within a human ear cavity between the tragus and an opposing projection of the pinna and a speaker unit located within said case, said case having one end having at least one sound opening adapted to extend over the auditory meatus without extending therein and said case having a diameter adjacent said one end substantially equal to the diameter of the case adjacent a middle portion thereof with the diameter of the case adjacent the other end being gradually reduced.

2. An earphone as set forth in claim 1 wherein said case adjacent said other end is provided with a tapered surface adapted to be engaged by said tragus and said opposing projection of the pinna to retain said earphone in the proper position.

3. An earphone as set forth in claim 1 wherein said case adjacent said other end is provided with a rounded surface adapted to be engaged by said tragus and said opposing projection of the pinna to retain said earphone in the proper position.

4. An earphone as set forth in claim 1 further comprising a pad member of sound permeable material secured to said one end of said case.

5. An earphone as set forth in claim 1 further comprising sound absorbing material disposed within said case between said other end and said speaker unit.

6. An earphone as set forth in claim 1 wherein said one end of said case is provided an arcuate convex configuration and a pad member having a complementary configuration secured to said one end of said case.

7. An earphone as set forth in claim 1 wherein said speaker unit is provided a circular diaphragm and said sound opening is formed with a diameter less than the diameter of said diaphragm but greater than the diameter of the auditory meatus.

8. An earphone as set forth in claim 1 further comprising an extension protruding from said other end of said case and connecting means associated with said extension for detachably connecting said earphone to a connecting band.

9. An earphone as set forth in claim 8 wherein said extension is detachably connected to said case and further comprising means for supplying an electric signal through said extension when said extension is connected to said case.

10. An earphone as set forth in claim 1 further comprising an annular support frame disposed intermediate said case and said one end thereof for supporting said speaker unit within said case and means for coupling said annular frame to said case and said one end thereof so as to provide a smooth cylindrical outer surface for said case, said annular frame and said one end of said case.

* * * * *